US007571731B2

(12) United States Patent
Choi et al.

(10) Patent No.: US 7,571,731 B2
(45) Date of Patent: Aug. 11, 2009

(54) ASPEN HAIR BRUSH FOR PREVENTING HAIR-LOSS

(76) Inventors: Doo-Yong Choi, 4585 Ironton St., Denver, CO (US) 80329; Duck-Joong Lee, 4585 Ironton St., Denver, CO (US) 80329

( * ) Notice: Subject to any disclaimer, the term of this patent is extended or adjusted under 35 U.S.C. 154(b) by 397 days.

(21) Appl. No.: 11/490,452

(22) Filed: Jul. 21, 2006

(65) Prior Publication Data

US 2008/0040878 A1 Feb. 21, 2008

(51) Int. Cl.
*A45D 24/00* (2006.01)
*A45D 24/16* (2006.01)

(52) U.S. Cl. ..... 132/148; 132/120; 132/163; 132/162

(58) Field of Classification Search ..... 132/148, 132/163, 120, 162
See application file for complete search history.

(56) References Cited

U.S. PATENT DOCUMENTS 5,782,858 A 7/1998 Cheng
5,904,700 A 5/1999 Guo
6,588,434 B2 7/2003 Taylor et al.
6,901,936 B2 * 6/2005 Kampel ..... 132/262
2004/0060141 A1 * 4/2004 Kim ..... 15/159.1

OTHER PUBLICATIONS

Camara, et al., Crystal chemistry of three tourmalines by SREF, EMPA, and SIMS, American Mineralogist, vol. 87, 1437-1442 (U.S. Oct. 1, 2002).

* cited by examiner

*Primary Examiner*—Robyn Doan

(57) ABSTRACT

A hair brush for preventing hair loss is provided. The hair brush of the current invention is comprised of a main body, a bristle body and a spike body. The main body of the brush is made of ABS (acrylonitrile-butadiene-styrene) polymer. The bristle body and the spike shape body are made of mixtures of anion emitting material, magnets and plastics such as silicon and polyurethane. Strength of the magnetic field generated from the bristle body and spike body is controlled to be 5 to 50 Gauss by controlling composition of carbon steel and strength of the magnetizer. Emitting anion concentration is controlled to be 400 to 700 each/$cm^3$ by adjusting composition of anion emitting materials. Combing 10 $cm^2$ area of scalp one minute a day for 30 days, number of hair loss a day decreased from over 100 each to less than 20 each.

3 Claims, 6 Drawing Sheets

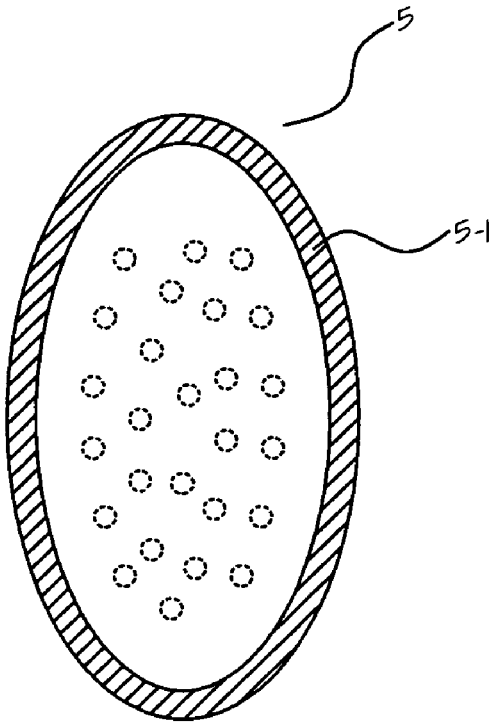
FIG. 3-a
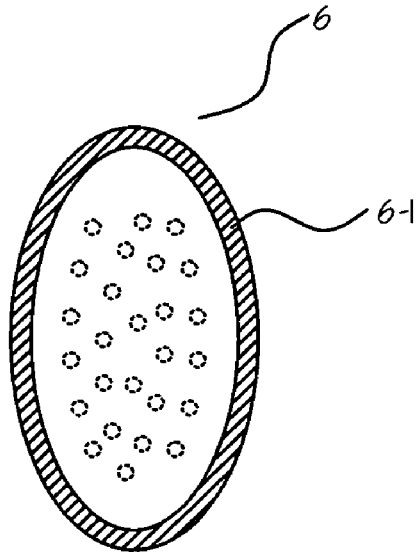
FIG. 3-b

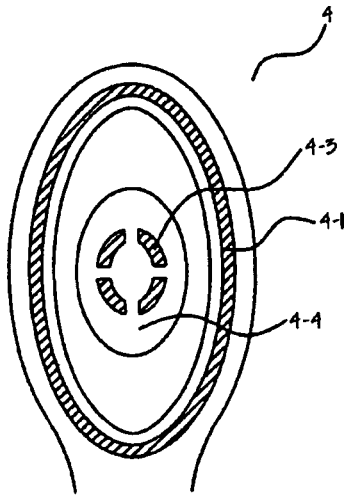
FIG. 4-a
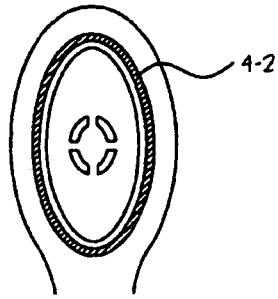
FIG. 4-b

ASPEN HAIR BRUSH FOR PREVENTING HAIR-LOSS

FIELD OF INVENTION

Current invention is related with a hair brush, especially related with a brush that is effective in preventing hair loss.

BACKGROUND OF THE INVENTION

Hair loss is a serious problem for young people and especially for women. Generally, it is understood that the hair loss is caused by chemical and biochemical reasons. Hormonal imbalances, fungal infections, and misuse of medicine are known as causes of hair loss. Theoretically, all those cause can be cured with proper treatment. However, still many people suffer from hair loss with unknown cause. Many kind of hair loss preventing methods are introduced in the market. Some of them are in a liquid shampoo type and some of them are stimulating the scalp with various method. Whatever the treatment method is, the effect is not sure. Meanwhile, the first thing that indicates hair loss is a brush or comb. The inventor had an idea that if it is possible to make a brush or a comb that can prevent hair loss, it would be very convenient to use and to confirm that hair loss is cured. Some of electric brush is equipped with an anion generator. But, their effect on preventing hair loss is not known to public. After repeated trial and error, finally, the inventor found a composite material that prevents hair loss and can be fabricated in a bristle form of a brush.

DESCRIPTION OF PRIOR ARTS

It is well known that nutrients to support the life and strength of hair are provided to follicles first and then transferred to hair. Therefore, what ever the cause of hair-loss is, the most direct reason for hair-loss is insufficient blood circulation in the scalp and around the follicles of the hair. When blood circulating in the scalp is not sufficient, the hair roots don't get enough nutrients to support the life and strength of the hair in the follicle.

However, the hardest place to get good blood circulation is the top surface of scalp. And this area is rarely stimulated except when shampooing or combing. The other chance of stimulating head is turning head around the pillow while sleeping. That is one reason why most of bald haired people still have hairs on sides of their head while the top of the head is completely bald.

The inventor focused on this fact and started to make some brushes that can stimulate the scalp and follicles of the hair. In oriental medicine, magnet is well known to facilitate blood circulation in capillary blood vessels under the skin of human body. Some of them are introduced to western society.

For example, U.S. Pat. No. 5,904,700 to Guo illustrates a magnetic apparatus pointer of traditional Chinese medicine for health care. The pointers with N pole and S pole may be positioned on both sides of human body making vertical cutting lines of magnetic force acting upon human body.

U.S. Pat. No. 5,782,858 to Cheng illustrates a medical apparatus which includes a first magnetic energy device with a magnetically conductive, rounded, pointed front end for acupuncturing acupuncture points of the fingers and around the eyes by means of a magnetic resonance, and a second magnetic energy device with a magnetically conductive concave front end for stimulating the orbicular is oculi muscle by means of a magnetic resonance.

Some other patents are focused on anion emitting. One of the materials that are known to emit anion is tourmaline. The general chemical formula is known as $Na(Al,Fe,Li,Mg,Mn)M_3Al(Si_6O_{18})(BO_3)_3(OH,F)_4$. Tourmaline crystals, when warmed, become positively charged at one end and negatively charged at the other. Fernando, et al. published on American Mineralogist, Vol. 87, pp 1437~1442, that $O^{-2}$ is abundant at the W (Ol) site of some tourmaline crystal. Similar research results are published in the same journal.

U.S. Patent Application 20040060141 to Kim illustrates an anion emission brush. The brush is made of a body portion consists of 0.2 to 0.4 percent by weight of one of germanium (Ge), zirconium (Zr) and beryllium (Be), and 1 to 2 percent by weight of tourmaline with 96.8 to 98 8 percent by weight of plastic. A brush portion and a grip portion are formed by admixing the primary mixture with nylon in an amount of 96.8 to 98 8 percent by weight and projecting the resulting mixture from the body portion to form the brush portion. No data of anion emitting count is exposed. It just describes some material.

U.S. Pat. No. 6,588,434 to Taylor, et al. illustrates a brush includes a self-contained ion generator that subject's material being brushed to an outflow of ionized air containing safe amounts of ozone. The ion generator includes a high voltage pulse generator whose output pulses are coupled between first and second electrode arrays. Output flow rate is about 90 feet/minute, ion content is about 2,000,000/cc and ozone content is about 2,000 ppb (over ambient). However, it is not sure that such high concentration of anion and ozone is harmless to human body.

None of the prior art illustrates an effect of preventing hair loss as shown by the hair brush of the current invention by maintaining optimized concentration of anion emitting and magnetic field at the same time.

SUMMARY OF THE INVENTION

Generally, it is understood that the hair loss is caused by chemical and biochemical reasons. However, many people suffer from hair loss with unknown cause. Many kind of hair loss preventing methods are introduced in the market. Whatever the treatment method is, the effect is not sure. Meanwhile, the first thing that indicates hair loss is a brush or comb. The inventor had an idea that if it is possible to make a brush or a comb that can prevent hair loss, it would be very convenient to use and to confirm that hair loss is cured. The brush for such purpose is comprised of a main body, a bristle body and a tubercle body. The main body of the brush is made of ABS (acrylonitrile-butadiene-styrene) polymer. The bristle body and tubercle body are made of mixtures of anion emitting materials such as micron particles of silver, gold, clay, tourmaline, titanium, amorphous silica, feldspar, and magnetizable materials, such as magnetite, ferrite, aloconi, and neodymium. Selected micro-particle components from above are mixed with plastics such as silicon or poly-urethane. The mixture of minerals and plastic are extruded and molded into a desired shape of bristle body and tubercle body. Strength of the magnetic field generated from the bristles and tubercles is controlled to be 5 to 50 Gauss by maintaining composition of carbon steel 22.5%, magnetite 0.5% and adjusting strength of a magnetizer. Emitting anion concentration is controlled to be 400 to 700 each/$cm^3$ by maintaining total concentration of anion emitting materials as low as 2.45%. 75% of the mixture is polyurethane. Therefore, the apparent physical property of the bristle and tubercle bodies is more elastic and flexible than other conventional brush's bristle to reach a more area of a scalp of a user. By combing 10 $cm^2$ area of scalp one minute a day for 30 days, number of hair loss a day decreased from over 100 each to less than 20 each.

BRIEF DESCRIPTION OF DRAWINGS

FIG. 3-*a* is a bottom view of a bristle body for the hair brush of the current invention for preventing hair-loss.

FIG. 3-*b* is a bottom view of a spike body for the hair brush of the current invention for preventing hair-loss.

FIG. 4-*a* is a front view of the head of the hair brush of the current invention for preventing hair-loss.

FIG. 4-*b* is a rear view of the head of the hair brush of the current invention for preventing hair-loss.

DETAILED DESCRIPTION OF THE PREFERRED EMBODIMENT

Figure 1:
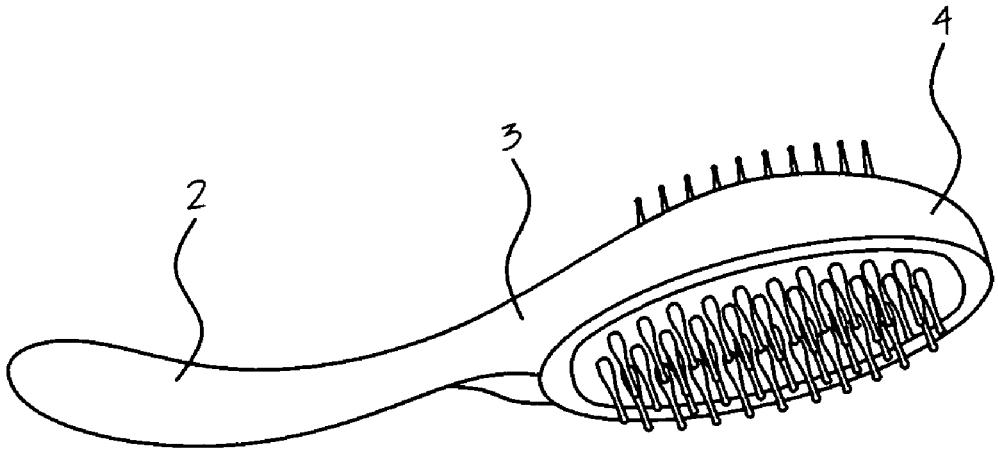
FIG. 1 is a perspective drawing of a hair brush of the current invention for preventing hair-loss.
Figure 2:
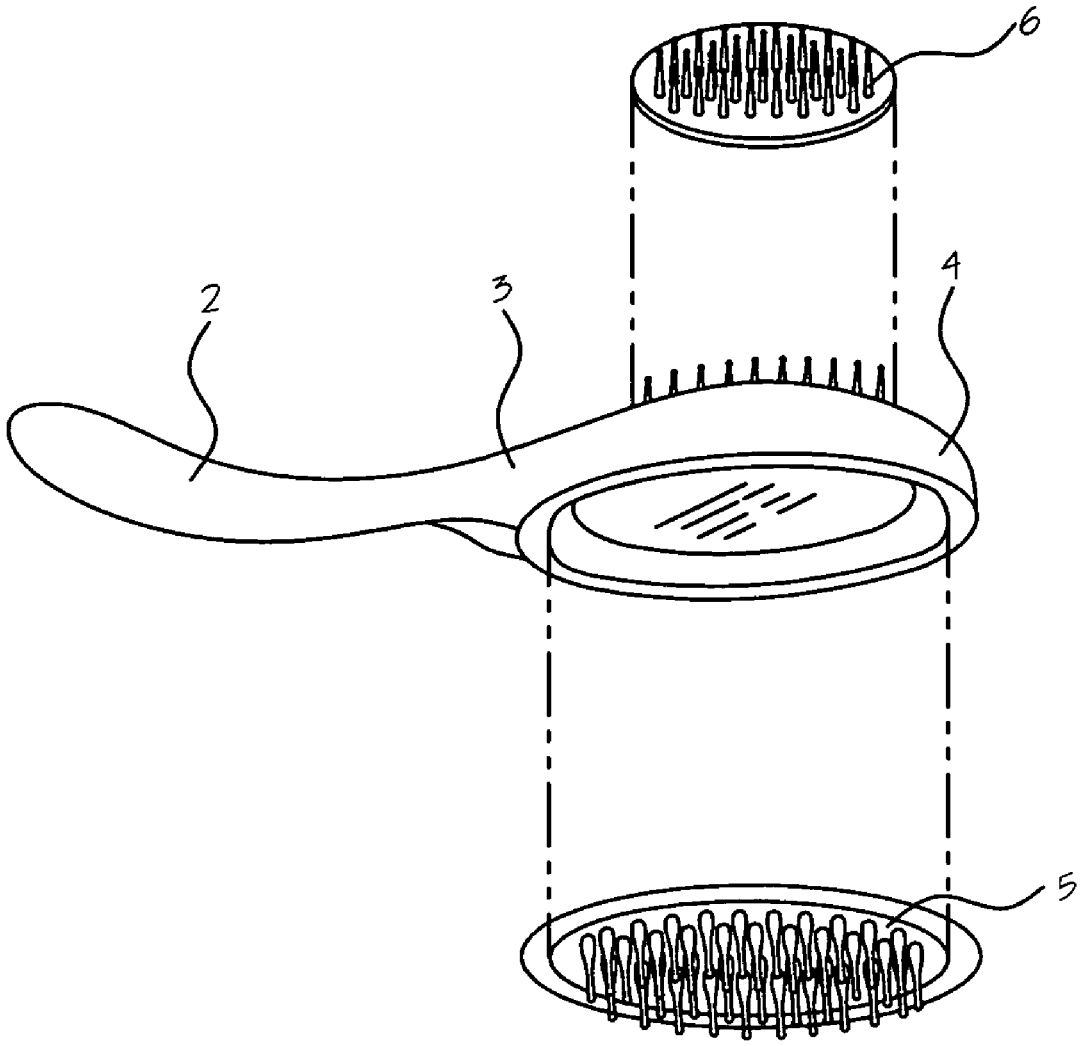
FIG. 2 is an exploded drawing of the hair brush of the current invention for preventing hair-loss.
Figure 5:
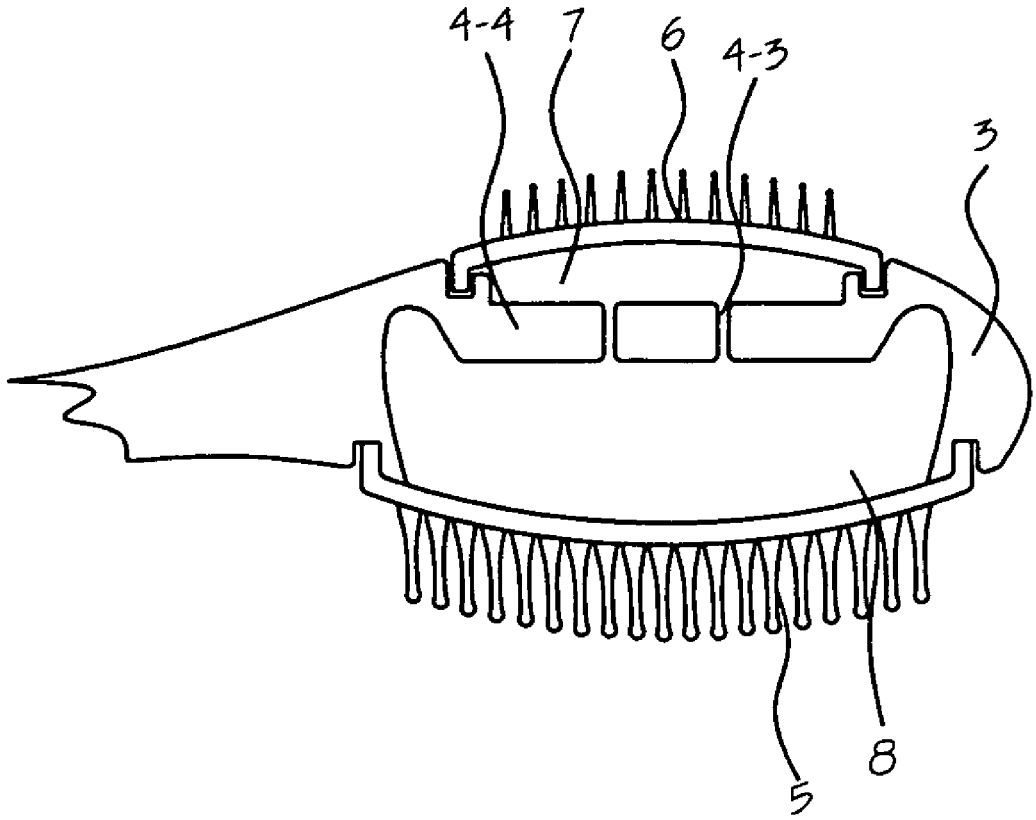
FIG. 5 is a cross sectional view of the head of the hair brush of the current invention for preventing hair-loss.

FIG. 1 is a perspective drawing of a hair brush (1) according to current invention for preventing hair-loss. The hair brush (1) according to current invention is comprised of a handle (2), a main body (3), a head (4), a bristle body (5), and a spike body (6). The spike body (6) is a very short bristle body that is made of the same material with the bristle body (5) but the length is very short to maintain stiffness for stimulating scalp. Among them, the handle (2), main body (3), and the head (4) are made of ABS resin via conventional injection molding method. Referring from FIG. 2 to FIG. 5, the structure of the hair brush (1) according to current invention for preventing hair-loss is as follows.

The head (4) has an upper void (7) and lower void (8) to receive the spike body (6) and the bristle body (5), respectively. The bottom view of the bristle body (5) and the spike body (6) is an oval shape. Each body has a shallow wall (5-1), (6-1) that is formed along the oval-ring shape perimeter of the bristle body (5) and spike body (6), respectively. The front view of the head (4) of the brush (1) according to current invention is also an oval shape. An oval shape groove (4-1) is developed along the perimeter of the front face of the head (4) to receive the shallow wall (5-1) and engage the bristle body (5) to the head (4). Another smaller oval shape groove (4-2) is developed on the rear face of the head (4). The bristle body (6) is engaged to the head (4) via this groove (4-2). Air holes (4-3) are developed on a mid-plate (4-3) of the head to allow air pass through from the upper void (7) to the lower void (8) freely. This structure renders repulsion force to the bristle body (5) and the spike body (6). However, the structure itself does not have any function of preventing hair loss.

Figure 6:
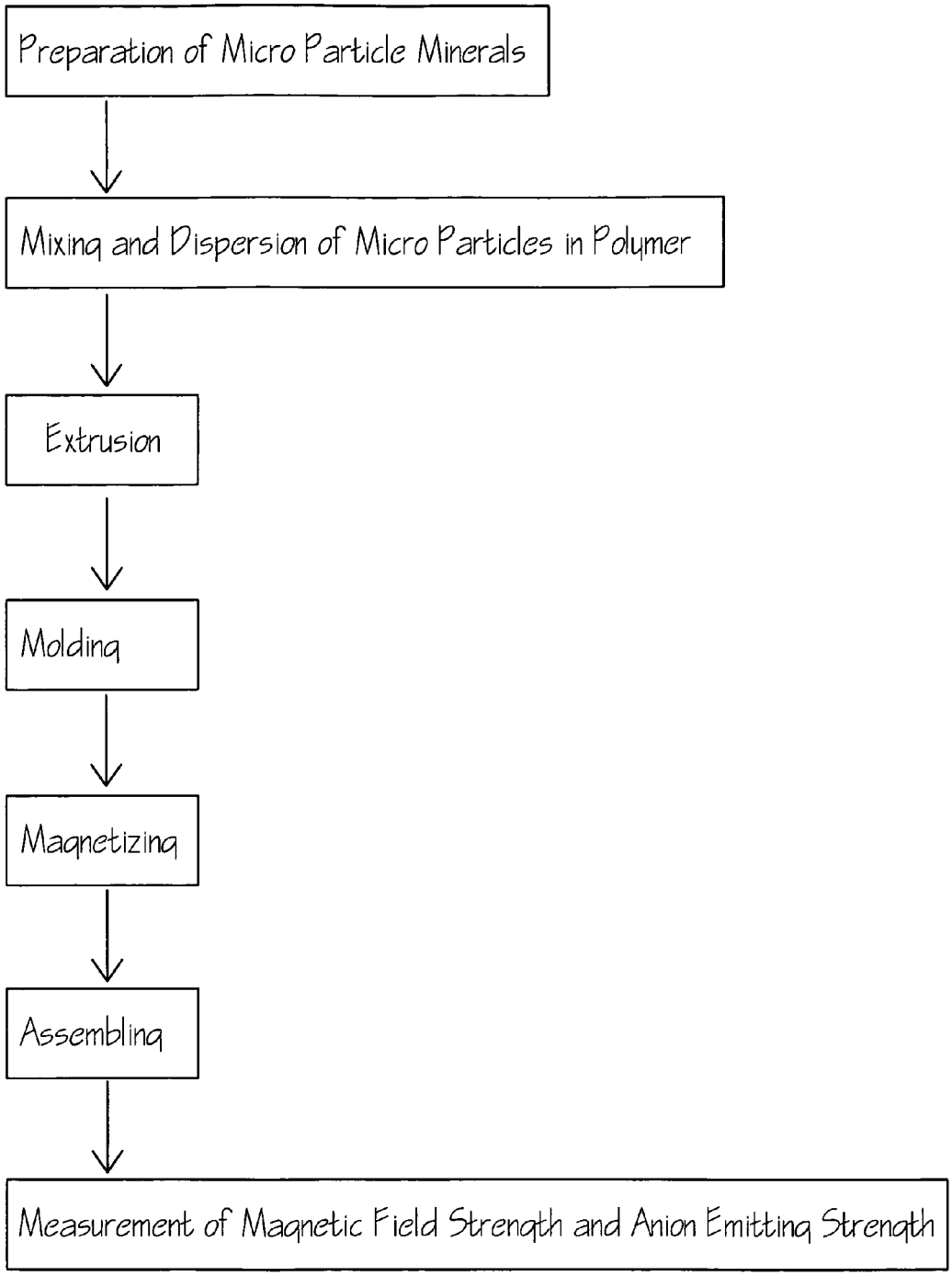
FIG. 6 is a schematic drawing of the manufacturing step of a hair-loss preventing brush of the current invention.

FIG. 6 is a schematic drawing of the manufacturing step of a hair-loss preventing brush (1) of the current invention.

First Step; Preparation of Micro Particle Minerals

In first step micro particles of magnetizable material and anion emitting materials having diameter of 1 to 5 μm are prepared.

90 kg (90 wt %) of iron oxide, 1 kg (1 wt %) of silver, 2 kg (2 wt %) of magnetite, 1 kg (1 wt %) of natural ore from Japan, 1 kg (1 wt %) of clay, 2.5 kg (2.5 wt %) of tourmaline, 0.5 kg (0.5 wt %) of titanium, 1.5 kg (1.5 wt %) of amorphous silica, and 0.5 kg (0.5 wt %) of feldspar powders are provided from commercial suppliers.

Second Step; Mixing and Dispersion of Micro Particles in Polymer

Micro particles of magnetizable material and anion emitting materials from step 1 and plastic pellets are mixed. 100 kg of micro particles from step 1 and 300 kg of polyurethane are mixed in a stirrer at ambient temperature for an hour with stirring speed of 60 rounds per minutes. Polyurethane is supplied in a pellet form of 3 to 5 mm diameter. By stirring the pellets of plastic and micro-particles of mineral components they are well dispersed in the mixture. The final composition of materials in the final mixture is summarized in Table 1.

Third Step; Extrusion

Mixture prepared in the second step is melt extruded at extruder temperature 190 to 210° C. During melt extrusion, the molten polyurethane surrounds the micro-particles of minerals in micrometer order.

TABLE 1

| Components | Wt % |
|---|---|
| Polyurethane | 75 |
| Iron oxide | 22.5 |
| Silver | 0.25 |
| Magnetite | 0.5 |
| Natural ore from Japan | 0.25 |
| Tourmaline | 0.625 |
| Titanium | 0.125 |
| Amorphous silica | 0.375 |
| Clay | 0.25 |
| Feldspar | 0.125 |

Fourth Step; Molding

Molten polyurethane, containing 25 wt % of mineral powders therein, from the extruder in the third step, is injected to a mold to form to be a bristle body (5) and a spike body (6).

Fifth Step; Magnetizing

The bristle body (5) and spike body (6) are exposed to a magnetizer to render a magnetic field to the bodies of (5) and (6).

Sixth Step; Assembling

Magnetized bodies of (5) and (6) are assembled to the brush (1) body, which is made of ABS (acrylonitrile-butadiene-styrene) polymer by injection molding.

Seventh Step; Measurement of Magnetic Field Strength and Anion Emitting Strength.

After assembling, anion emitting strength and magnetic field strength is measured. Anion concentration is measured with Echo Model No. EB-12 indicates 400 to 700 each of anion/cm$^3$. Magnetic field strength measured with KENETEC Model No.TM-501 shows 5 to 50 Gauss.

Experiment; Hair loss preventing ability is measured by combing 10 cm$^2$ area of human scalp one minute a day for 30 days.

| No. | Gender | Age | Hair loss/day (before treatment) | Hair loss/day (after treatment) |
|---|---|---|---|---|
| 1 | Female | 47 | 90~110 | 5~8 |
| 2 | Male | 36 | 90~100 | 5~9 |
| 3 | Male | 48 | 100~120 | 6~10 |
| 4 | Female | 31 | 80~100 | 5~7 |

As shown in Table 1, all the result shows that regardless of gender and age the brush of the current invention is effective in preventing hair-loss. The number of hair-loss less than 10 each per day is normal for average person.

What is claimed is:

1. A hair brush for preventing hair loss, decreasing number of hair-loss from over 100 each per day to less than 20 each by combing 10 $cm^2$ area of human scalp one minute a day for 30 days, is comprised of:

a main body that is made of ABS (acrylonitrile-butadiene-styrene) polymer, and a bristle body that has magnetic field strength of 5 Gauss and anion emitting concentration of 400 each/$cm^3$ is comprised of a mixture of 75 wt % of polyurethane, 22.5 wt % of iron oxide, 0.25 wt % of silver, 0.5 wt % of magnetite, 0.25 wt % of natural ore from Japan, 0.25 wt % of clay, 0.625 wt % of tourmaline, 0.125 wt % of titanium, 0.375 wt % of amorphous silica, 0.125 wt % of feldspar and is extruded at a temperature of 210° C. followed by molding and magnetizing, and a spike body that has magnetic field strength of 5 Gauss and anion emitting concentration of 400 each/$cm^3$ is comprised of a mixture of 75 wt % of polyurethane, 22.5 wt % of iron oxide, 0.25 wt % of silver, 0.5 wt % of magnetite, 0.25 wt % of natural ore from Japan, 0.25 wt % of clay, 0.625 wt % of tourmaline, 0.125 wt % of titanium, 0.375 wt % of amorphous silica, 0.125 wt % of feldspar and is extruded at a temperature of 210° C. followed by molding and magnetizing.

2. The hair brush for preventing hair loss of claim 1, wherein the magnetic strength of the brush body and the spike body is 50 Gauss.

3. The hair brush for preventing hair loss of claim 1, wherein the anion emitting concentration of the brush body and the spike body is 700 each/$cm^3$.

* * * * *